US007954266B2

(12) United States Patent
Fok

(10) Patent No.: US 7,954,266 B2
(45) Date of Patent: Jun. 7, 2011

(54) CARD HOLDER

(76) Inventor: Shek Hung Fok, Kowloon (HK)

( * ) Notice: Subject to any disclaimer, the term of this patent is extended or adjusted under 35 U.S.C. 154(b) by 0 days.

(21) Appl. No.: 12/702,306

(22) Filed: Feb. 9, 2010

(65) Prior Publication Data

US 2011/0047837 A1 Mar. 3, 2011

(30) Foreign Application Priority Data

Aug. 27, 2009 (CN) ..... 2009 2 0309032

(51) Int. Cl.
*G09F 3/18* (2006.01)

(52) U.S. Cl. ..... 40/661.04; 40/653; 40/651

(58) Field of Classification Search ..... 40/653, 40/634, 765, 766; 292/329, 190, 241, 145, 292/218, 202, 256, 304; 70/756 R, 456 R, 70/57, 57.1, 63

See application file for complete search history.

(56) References Cited

U.S. PATENT DOCUMENTS

| | | | | | |
|---|---|---|---|---|---|
| 306,524 | A | * | 10/1884 | Reeve | 292/329 |
| 2,615,324 | A | * | 10/1952 | Meeker | 70/459 |
| 2,633,012 | A | * | 3/1953 | Hewitt | 70/408 |
| 4,324,121 | A | * | 4/1982 | Richter | 70/459 |

* cited by examiner

*Primary Examiner* — Cassandra Davis

(57) ABSTRACT

A card holder (100) includes a base (1) and a clamping means (20) to attach the card holder to garment. A card is grasped on the base. The base has a first face (13) and an opposite second face (15). The clamping means includes a clamp (2) and a slot (12) for locking the clamp. The slot is defined in the base. The clamp is rotatably mounted to the base with an end retractably moving outwards. The retractably moving end can be locked in or released from the slot, so that the card holder can be attached to or removed from the bearer's garment in an easy way.

15 Claims, 5 Drawing Sheets

CARD HOLDER

BACKGROUND OF THE INVENTION

The present invention relates to a holder for bearing cards, and especially to a holder for accommodating card therein and attaching to the bearer's garment with a kind of clamp In nowadays, we have various cards, such as identification card, bank card, metcard, business card, employees' nameplate, and etc., and many cards have a magnetic strip, microchip, or the like for storing important information of the bearer. It is known to provide bearer with a holder for such cards which can be attached to their clothing by way of a retractable spring clip. A well-known spring clip includes a pair of pressing wings which are assembled together with a spring so as to form a tip at an end thereof for snapping the bearer's clothing. Usually, the clip is very tight. The user shall heavily press the wings for attaching or removing the holder from the clothing, which is very hard for the user. The clip is easily destroyed under such strongly and repeatedly pressing operation as well. Furthermore, the holder is easily suspend in a slanting way, and the card fitted in the holder looks slanting accordingly, which is inconvenient to read the information from the card, and looks informal and not good in appearance of the bearer.

Another advantage of the prior card holder is very easily broken when it is made from plastic film. Otherwise the holder is made at a great thickness from common plastic.

Therefore, an improved card holder is desired which overcomes the disadvantages of the prior art.

BRIEF SUMMARY OF THE INVENTION

A main object of the present invention is to provide a durable card holder, which can be easily attached to or removed from bearer's garment, and can tightly and tidily suspend the card over bearer's garment without slanting.

To obtain the above object, a card holder in the present invention comprises a base and a clamping means to attach the holder to garment. A card is grasped on the base. The base has a first face and an opposite second face. The clamping means comprises a clamp and a slot for locking the clamp. The slot is defined in the base. The clamp is rotatably mounted to the base with an end retractably moving outwards. The retractably moving end can be locked in or released from the slot, so that the card holder can be attached to or removed from the bearer's garment in an easy way.

In a preferable embodiment, the clamping means comprises a recess formed in the first face of the base, and the clamp is pivotally mounted to the recess with the retractably moving end extending outwards from an opening defined at an edge of the base. The clamp forms a hook at the retractably moving end thereof for locking the clamp in the slot when the holder is attached to garment. The recess is substantially configured in a shape of half circle with a diameter thereof being engaged with the edge of the base, and the slot is defined in the recess. Accordingly the clamp substantially has a semicircular shape. When the card holder is attached to bearer's garment, the retractably moving end of the clamp extends from the first face of the base, passes a buttonhole or the like, or grasps collar of garment, then reverses to the opposite second face until the hook is locked in the slot. Therefore, the card holder can tightly and tidily suspend the card over the bearer's garment in a way without slanting. The bearer looks in good appearance with the card, and others can easily read the card as well. Additionaly, the clamp can be fully accommodated in the recess with the hook colliding with the edge of the base when the user releases the holder from his clothing. It is very convenient for the user to keep the card holder, for example to keep it in his wallet or pocket.

The card holder is preferably made from metal. The base forms a cut-away portion at edges thereof, so that a card reading machine can easily and sensitively read information stored in the card. The metal base of the holder can be very thin, but it is very stiff and durable in use.

Other objects, advantages and novel features of the invention will become more apparent from the following detailed description of a preferred embodiment thereof when taken in conjunction with the accompanying drawings, wherein:

DETAILED DESCRIPTION OF THE INVENTION

Figure 1:
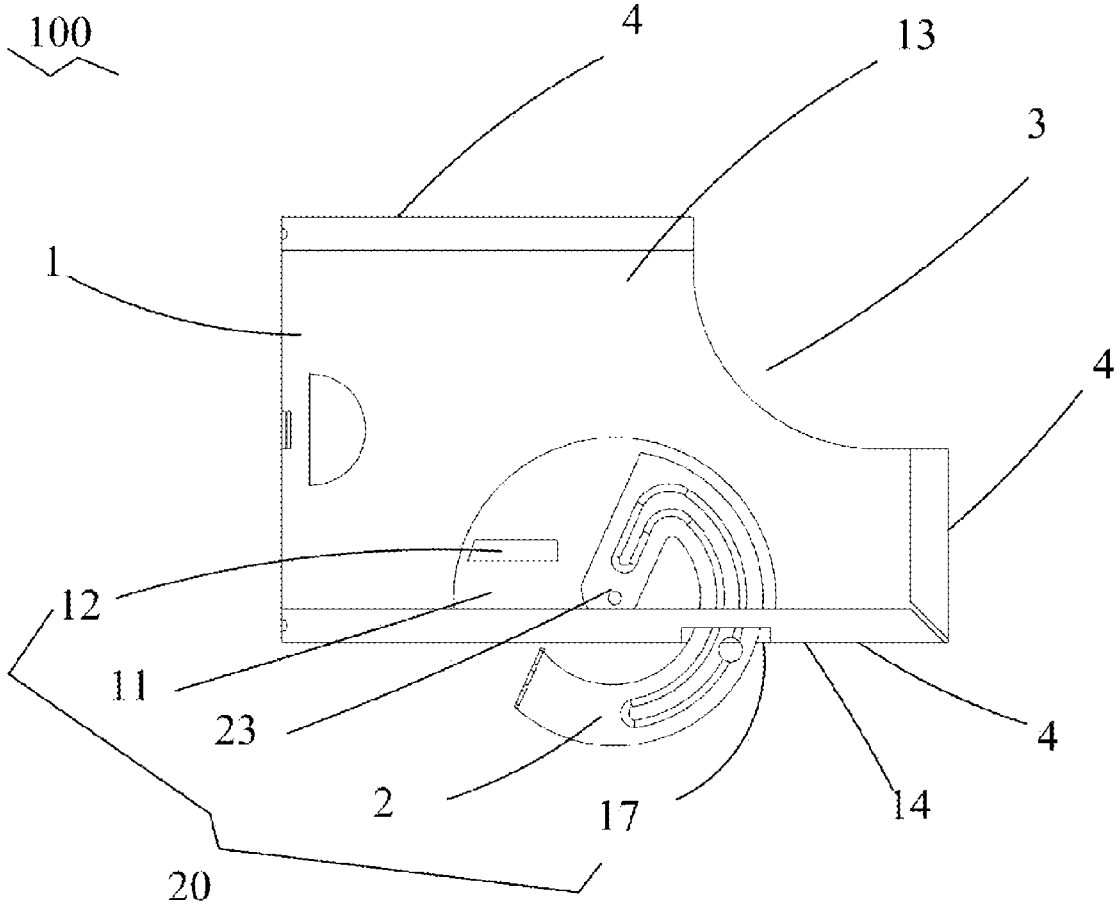
FIG. 1 is a front view of a card holder in accordance with an embodiment of the present invention.
Figure 2:
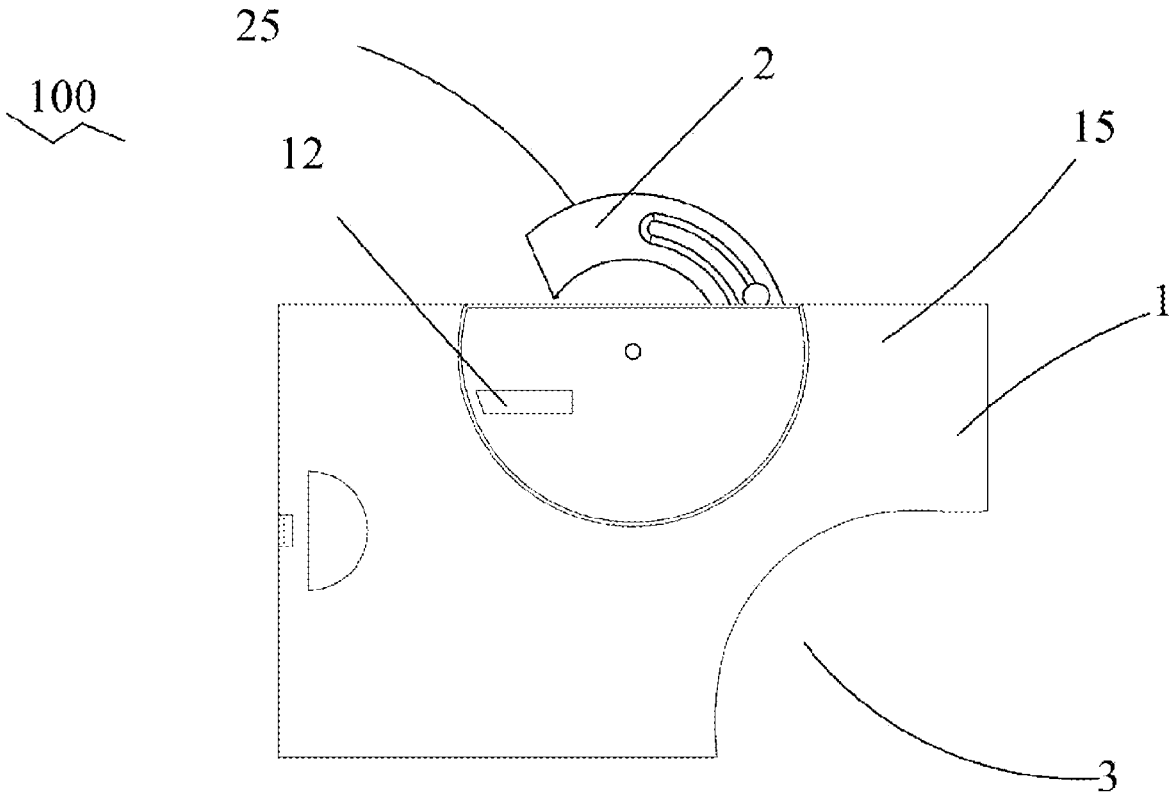
FIG. 2 is a rear view of the card holder of FIG. 1.

Referring to FIGS. 1 and 2, a card holder 100 according to the embodiment of the present invention includes a base 1 and a clamping means 20. The base 1 is used to bear card thereon, and the clamping means 20 attaches the holder 100 to garment. The base 1 has a first face 13 and an opposite second face 15. In a preferable embodiment, the base 1 is substantially in a shape of rectangle (but not limited to). A flange 4 extends substantially around and outwards of the first face 13. In a preferable embodiment, the flange 4 extends fully around three edges of the first face 13, but only partially at a corner of the rectangular shape. The part at the corner without the flange 4 forms a cut-away portion 3, which is designed for card reading machines to easily and sensitively read the information from the card. A card is inserted onto the first face 13 of the base 1 and is grasped by the flange 4. It is understood that the cut-away portion 3 can be adaptably configured at any edge or portion of the base 1 according to where the magnetic strip, microchip, or the like is located in the card.

The clamping means 20 includes a recess 11 and a clamp 2. Herein, the recess 11, substantially in a shape of half circle, is configured in the first face 13 with its diameter coinciding with an edge 14 of the base 1. The recess 11 is preferably located at the middle of the edge 14, but not limited to.

The clamp 2 is pivotally mounted into the recess 11 with an end 25 retractably extending outwards from an opening 17 in the base 1. The opening 17 is preferably defined at a bottom of the flange 4 at the edge 14. The recess 11 defines a slot 12 therethrough for locking the clamp 2 at the extending end 25. The slot 12 and the opening 17 are located in either quarter circle of the recess 11.

Figure 3:
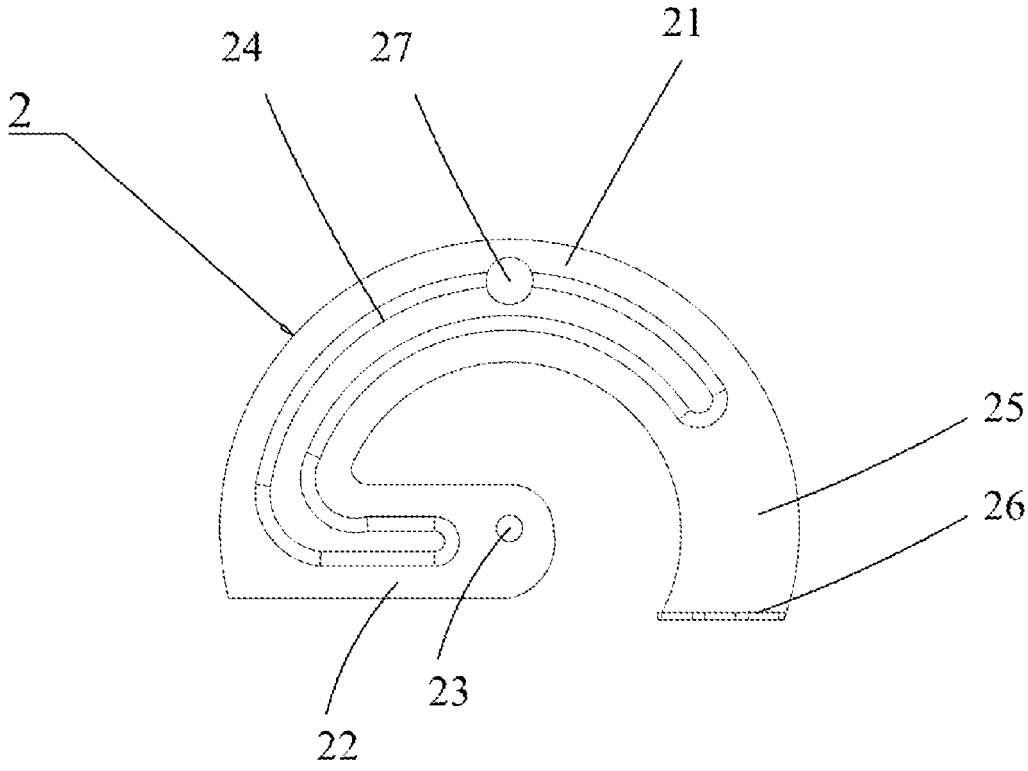
FIG. 3 is a front view of an element of the card holder of the present invention.
Figure 4:
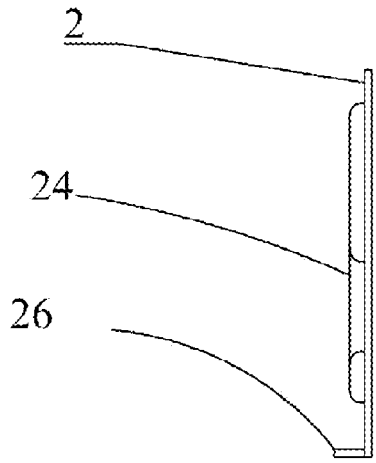
FIG. 4 is a lateral view of the element of FIG. 3.

Referring to FIGS. 3 and 4 together, the clamp 2 has an arc body 21, which is substantially in a semicircular shape according to the half-circle shape of the recess 11. The arc body 21 is curved at one end so as to form a pivot arm 22, and preferably is curved along a radial direction, but not limited to the radial direction. A pivot 23 is defined at the end of the pivot arm 22, and preferably at the radial center of the semicircular shape. The arc body 21 circumferentially extends at the other end 25 to form a hook 26.

The arc body 21 can be desirably designed at an adaptable width according to a size of buttonhole of the bearer's garment, but is not limited to such width. A stiffening rib 24 can be desirably configured on the arc body 21. An attachment aperture 27 can be desirably defined at the middle of the circular circumference of the arc body 21, or any applicable position in the base 1 or the clamp 2, so that the bearer can use a sling or rope to hang the card holder 100.

After the clamp 2 is assembled to the base 1, the clamp 2 is rotatably mounted at the pivot 23 in the recess 11. Herein the pivot 23 is preferably fitted at the radial center of the recess 11. Therefore, the pivot arm 22 can rotate around the pivot 23 in the recess 11. Accordingly, the circumferentially extending end 25 of the clamp 2, namely the free end 25 with the hook 26, passes through the opening 17 in the base 1, and retractably move outwards.

In use, the card (not shown) is inserted and grasped in the base 1, and the holder 100 should be attached to the bearer's garment. Then the user pulls the clamp 2 outwards and passes the free end 25 through a buttonhole or the like, then inserts it into the slot 12 until the hook 26 is gripped in the slot 12 for locking the holder 100. As a result, the holder 100 with the card therein is tightly and tidily suspended over the bearer's garment in order to regularly show information, such as a photo, name, number, and etc.

Figure 5:
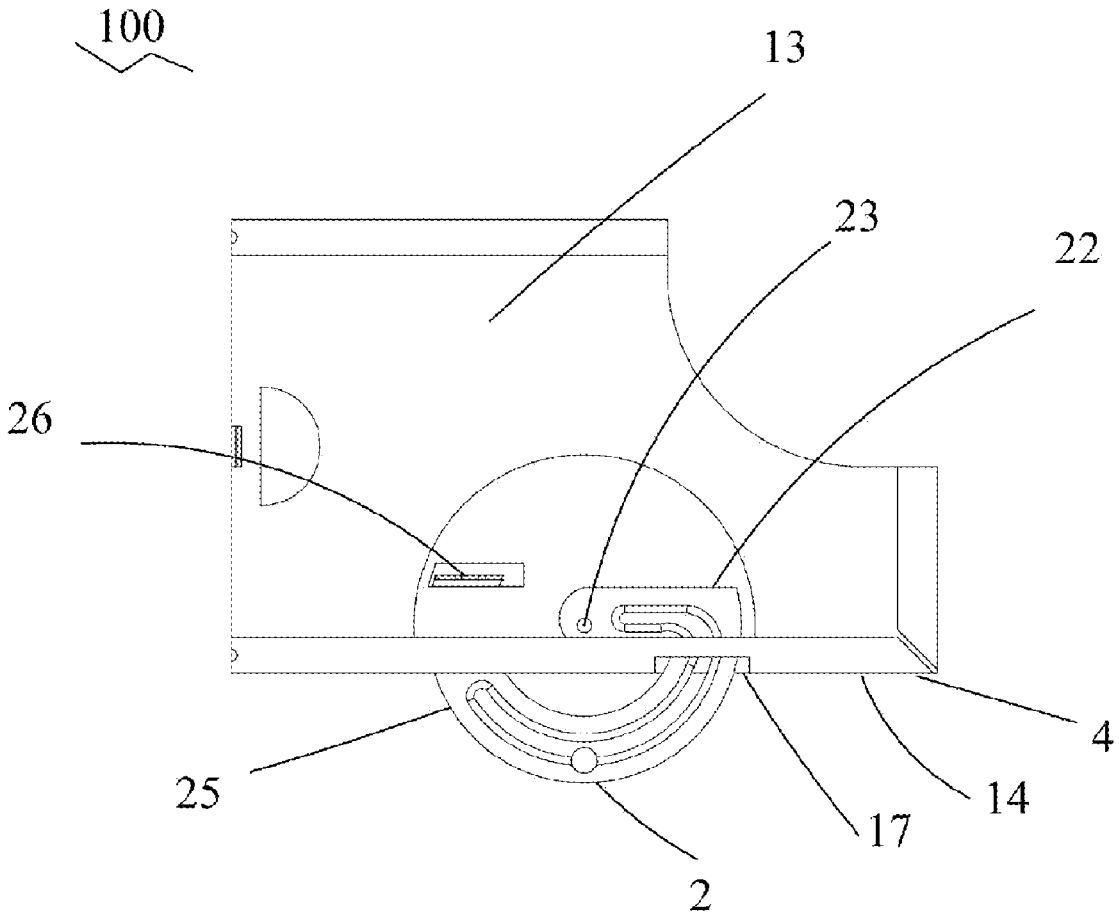
FIG. 5 is a front view of the card holder in use of the present invention.
Figure 6:
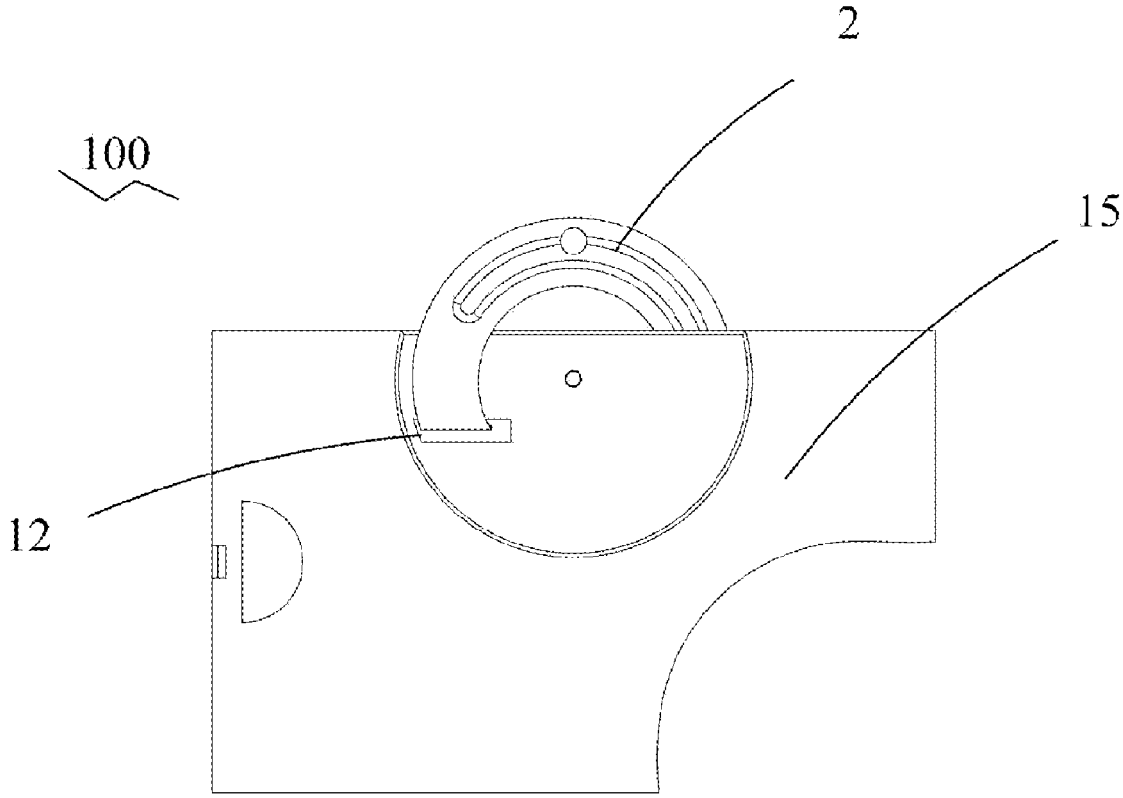
FIG. 6 is a rear view of FIG. 5.

Also referring to FIGS. 5 and 6, the card has been removed from the holder 100 for illustrating the holder 100 in use. During the holder 100 being attached to the bearer's garment, the clamp 2 rotates around the pivot 23 in the recess 11, and the free end 25 thereof extends outwards from the first face 13 to the opposite second face 15 until the hook 26 is locked in the slot 12. Herein, the pivot arm 22 may collide against the flange 4 at the edge 14. Reversely, the user needs releasing the holder 100 from the garment, he shall release the hook 26 from the slot 12 and then release it from the buttonhole, and may push the arc body 21 back to the recess 11. The clamp 2 can be fully or partially accommodated in the recess 11, while the hook 26 may collide with the edge 14 of the base 1, or extend outwards. It is very convenient for the user to keep the card holder when the clamp 2 is fully accommodated in the recess 11 with the hook 26 colliding with the edge 14 of the base 1. For example, the user may keep the holder 100 in his wallet or pocket when he does not need bearing it. Therefore, not only the user can readily attach the card holder 100 to or remove it from his garment, but also he can easily keep it.

In a preferable embodiment, the holder 100 is made from metal, thus it is very stiff and durable for use, and can be made at a thin thickness. The recess 11 and the stiffening rib 24 are formed through impact molding. It is understood that other materials in the art are applicable as well. Since the card holder 100 is made from metal, the information stored in the card is secured from being undesirably disclosed. Herein, the cut-away portion 3 of the base 1 exposes a corner or other desirable portion of the card, so that a reading machine can sensitively read the card if necessary.

It is understood that the cut-way portion 3 may be not necessary, thus the flange 4 is continuous at three edges of the base 1.

It is understood that the holder 100 can be attached to a collar or any other desirable position of the garment using the clamp 2 of the present invention.

While the invention has been described in conjunction with specific embodiments, it is evident that numerous alternatives, modifications, and variations will be apparent to those skilled in the art in light of the forgoing descriptions. The scope of this invention is defined only by the following claims.

What is claimed is:

1. A card holder comprising:

a base having a first face and an opposite second face; and a clamping means to attach the holder to garment;

wherein said clamping means comprises a clamp and a slot for locking the clamp; the slot is defined in the base; the clamp is rotatably mounted to the base with an end retractably moving outwards; said retractably moving end can be locked in or released from said slot; and said clamping means further comprises a recess formed in the first face of the has and the clamp is pivotally mounted to said recess with said retractably moving end extending outwards from an opening defined in the base.

2. The card holder according to claim 1, wherein said clamp forms a hook at the retractably moving end thereof for locking said clamp in the slot when the holder is attached to garment.

3. The card holder according to claim 2, wherein said retractably moving end extends from the first face of the base to the opposite second face until the hook is locked in the slot when the card holder is attached to garment.

4. The card holder according to claim 1, wherein said recess is substantially configured in a shape of half circle with a diameter thereof being engaged with an edge of the base, and said slot is defined in the recess.

5. The card holder according to claim 4, wherein said clamp substantially has a semicircular shape according to said recess.

6. The card holder according to claim 5, wherein said clamp has an arc body, one end of the arc body opposite to said retractable end is curved to form a pivot arm, and the pivot arm is fixed in said recess at a pivot.

7. The card holder according to claim 6, wherein said pivot arm is radially curved, and the pivot is coupled with the radial center of the recess.

8. The card holder according to claim 1, wherein said holder is made from metal.

9. The card holder according to claim 8, wherein a stiffening rib is formed on the clamp.

10. A card holder comprising:

a base having a first face and an opposite second face; and a clamping means to attach the holder to garment;

wherein said clamping means comprises a clamp and a slot for locking the clamp; the slot is defined in the base; the clamp is rotatably mounted to the base with an end retractably moving outwards; said retractably moving end can be locked in or released from said slot; and said base forms a cut-away portion at edges thereof for card reader reading information from the card in said holder.

11. The card holder according to claim 10, wherein a flange extends substantially around and outwards of the first face of the base for grasping the card.

12. The card holder according to claim 11, wherein the base is substantially in a shape of rectangle, and the flange extends around three edges of the first face.

13. The card holder according to claim 10, wherein an attachment aperture is formed in the base or the clamp.

14. A card holder comprising:

a base having a first face and an opposite second face; and a clamp;

wherein a slot is defined in the base for locking said clamp, the clamp is rotatably mounted to the base at one end, the other end thereof forms a hook and can retractably move outwards from the first face to the opposite second face of the base so as to lock the hook in said slot when the card holder is attached to garment; and a recess substantially in a shape of half circle is formed in the base, and the clamp is pivotally mounted to said recess at the center of the recess.

15. The card holder according to claim 14, wherein said card holder is made from metal.

* * * * *